US011505976B2

(12) United States Patent
Doherty

(10) Patent No.: US 11,505,976 B2
(45) Date of Patent: Nov. 22, 2022

(54) PORTABLE DOOR LOCK

(71) Applicant: P. J. Doherty, Littleborough (GB)

(72) Inventor: P. J. Doherty, Littleborough (GB)

( * ) Notice: Subject to any disclaimer, the term of this patent is extended or adjusted under 35 U.S.C. 154(b) by 236 days.

(21) Appl. No.: 16/754,905

(22) PCT Filed: Oct. 18, 2018

(86) PCT No.: PCT/GB2018/053017
§ 371 (c)(1),
(2) Date: Apr. 9, 2020

(87) PCT Pub. No.: WO2019/077360
PCT Pub. Date: Apr. 25, 2019

(65) Prior Publication Data

US 2020/0263465 A1 Aug. 20, 2020

(30) Foreign Application Priority Data

Oct. 19, 2017 (GB) ..... 1717179
Oct. 31, 2017 (GB) ..... 1717931
Jan. 24, 2018 (GB) ..... 1801138

(51) Int. Cl.

| | |
|---|---|
| ***E05C 19/18*** | (2006.01) |
| ***E05C 19/00*** | (2006.01) |
| ***E05B 15/16*** | (2006.01) |
| ***E05B 17/00*** | (2006.01) |
| *E05B 63/00* | (2006.01) |

(52) U.S. Cl.
CPC ..... *E05C 19/003* (2013.01); *E05B 15/1635* (2013.01); *E05B 17/0041* (2013.01); *E05B 2015/1664* (2013.01); *E05Y 2900/132* (2013.01); *Y10T 292/34* (2015.04)

(58) Field of Classification Search
CPC ..... E05C 19/18; E05C 19/182; Y10T 292/34; Y10T 292/37; Y10T 292/373; Y10T 292/376; Y10T 292/379; Y10T 292/382; Y10T 292/385; Y10T 292/394; Y10T 292/397
See application file for complete search history.

(56) References Cited

U.S. PATENT DOCUMENTS

| | | | | |
|---|---|---|---|---|
| 14,834 A | | 5/1856 | Smith | |
| 55,477 A | * | 6/1866 | Enos | E05C 19/18 292/288 |
| 77,651 A | | 5/1868 | Perkins | |
| 208,176 A | * | 9/1878 | Ingalls | E05C 19/182 292/293 |
| 360,897 A | | 4/1887 | Moore | |
| 452,947 A | | 5/1891 | Morris | |
| 496,887 A | | 5/1893 | Matthews | |
| 587,496 A | * | 8/1897 | Stone | E05C 19/182 292/293 |

(Continued)

*Primary Examiner* — Carlos Lugo
(74) *Attorney, Agent, or Firm* — David Guerra

(57) ABSTRACT

A door locking device having a locking bar with a first section and a second section pivotally connected to the first section and, the second section being provided with a protrusion. There is also provided a housing having a first end comprising a face and a recess therein. The first section of the locking bar is received and retained, within the recess of the housing, and the pivotal connection is orientated with an axis of rotation that is non-parallel with the longitudinal axis of the locking bar.

15 Claims, 15 Drawing Sheets

(56) References Cited

U.S. PATENT DOCUMENTS

| | | | | | |
|---|---|---|---|---|---|
| 652,046 | A | * | 6/1900 | Schutz | E05C 19/182 292/294 |
| 945,558 | A | | 1/1910 | Lent | |
| 1,064,449 | A | | 6/1913 | Lochhead | |
| 1,302,890 | A | | 5/1919 | Bach et al. | |
| 2,969,253 | A | * | 1/1961 | Schettl | E05C 19/182 292/294 |
| 3,411,817 | A | | 11/1968 | Carver | |
| 4,169,619 | A | * | 10/1979 | McCracken | E05C 19/182 292/290 |
| 4,285,535 | A | * | 8/1981 | Leary | E05C 19/182 292/258 |
| 4,387,919 | A | | 6/1983 | Quaintance et al. | |
| D272,411 | S | * | 1/1984 | Yarosz | D8/331 |
| 4,429,913 | A | | 2/1984 | Bey | |
| 4,589,692 | A | * | 5/1986 | Boyd | E05C 19/182 292/297 |
| 5,566,993 | A | | 10/1996 | Olivas | |
| 5,667,262 | A | * | 9/1997 | Planchon | E05C 19/182 292/288 |
| 6,409,236 | B1 | | 6/2002 | Steele | |
| 6,926,316 | B2 | * | 8/2005 | Patire | E05C 19/182 292/290 |

* cited by examiner

FIG 8
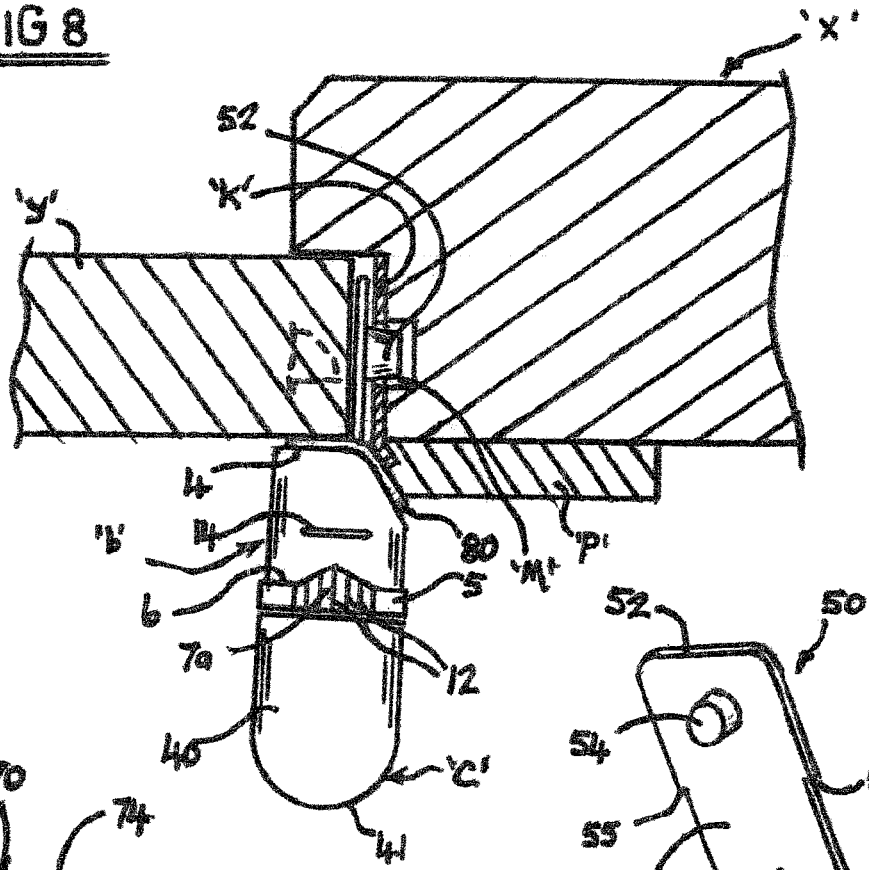
FIG 9
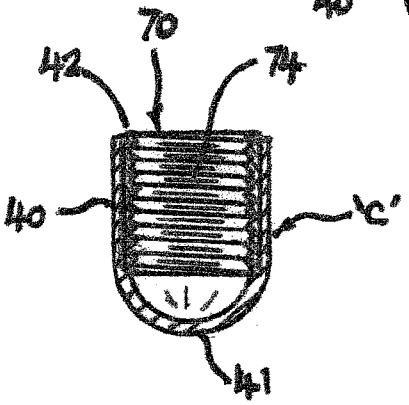
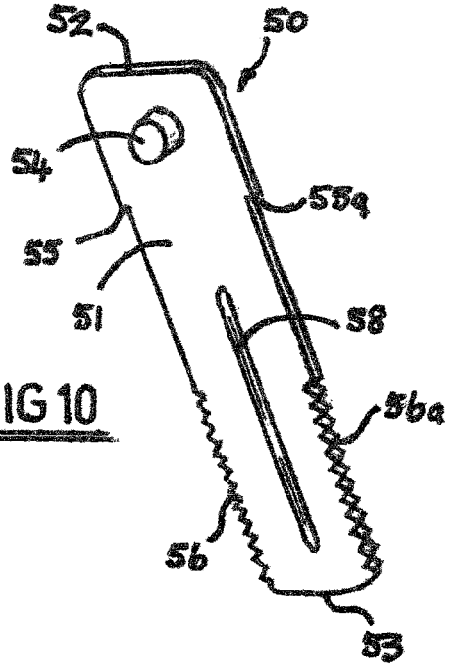
FIG 10
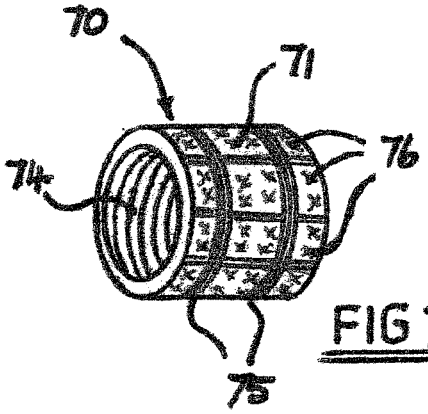
FIG 11
FIG 12
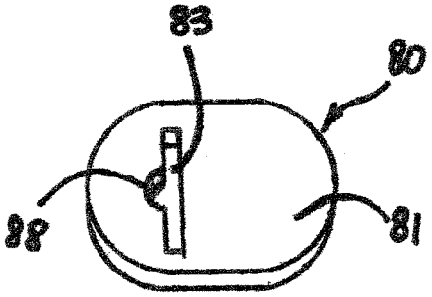

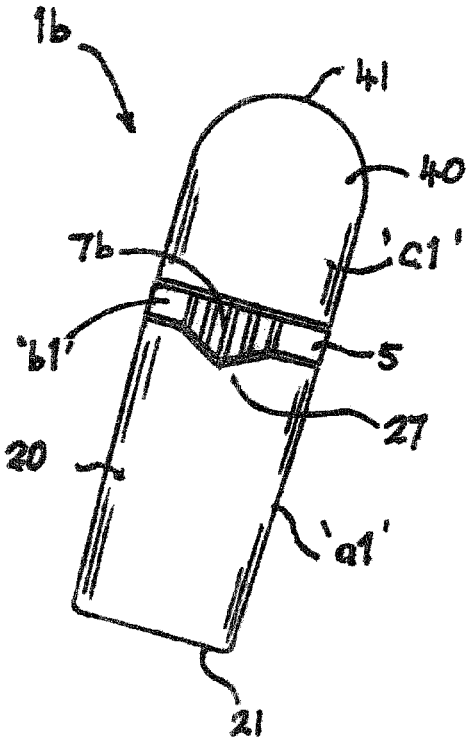
FIG 16
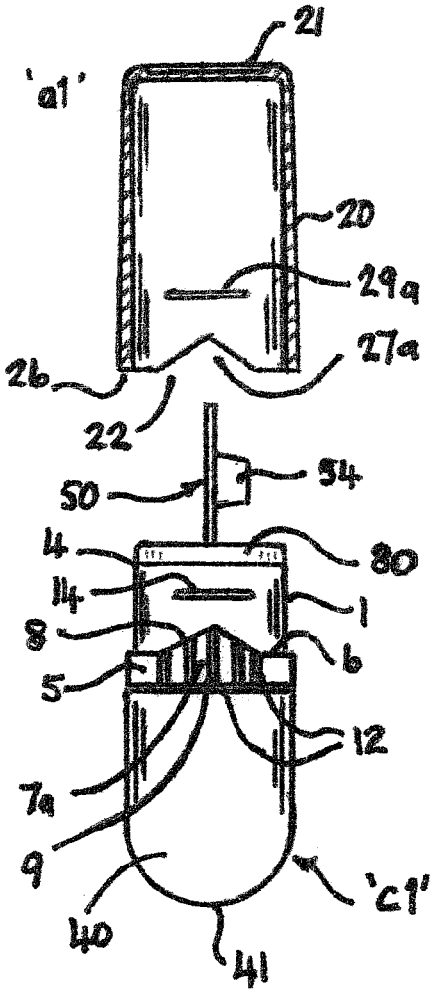
FIG 17
FIG 18
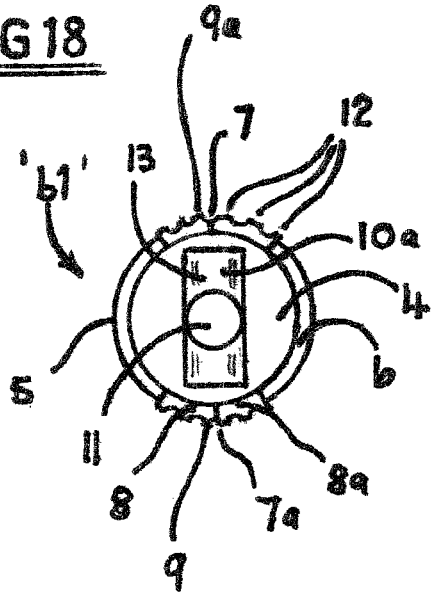

FIG 21
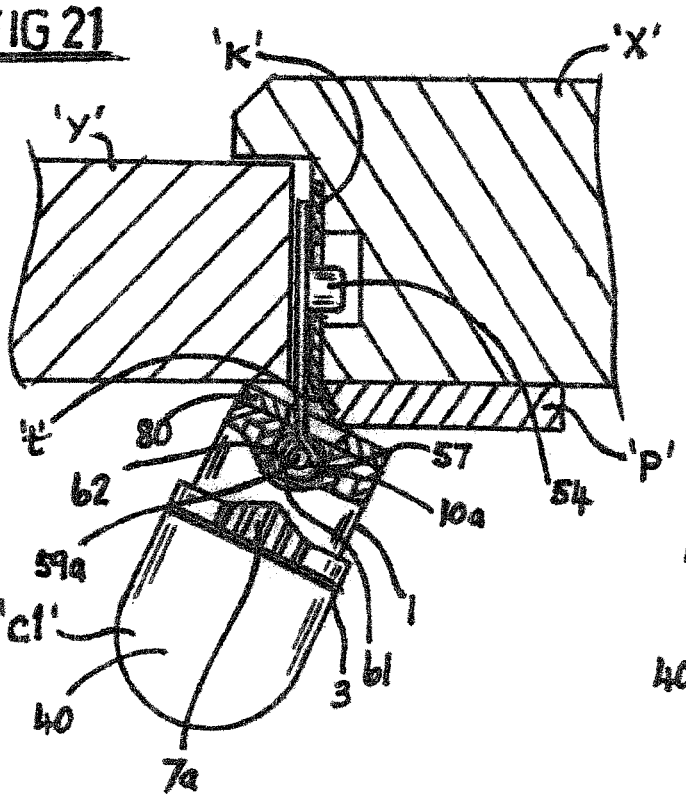
FIG 22
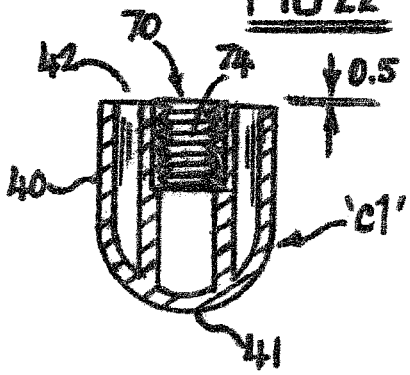
FIG 23
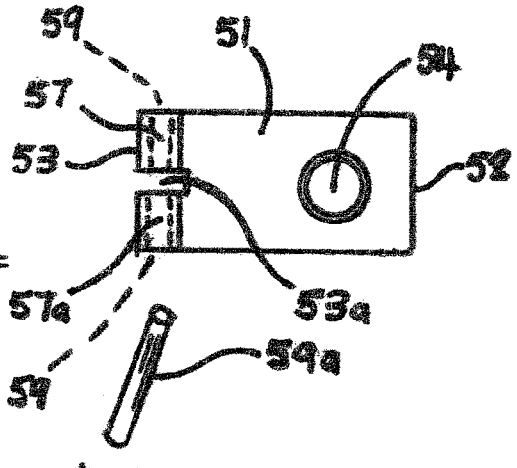
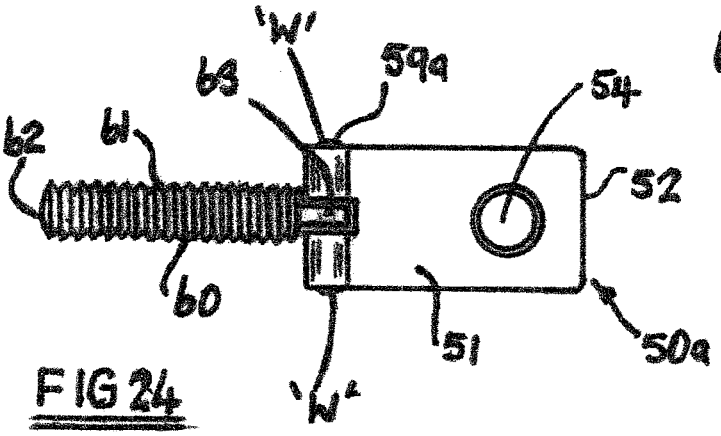
FIG 24
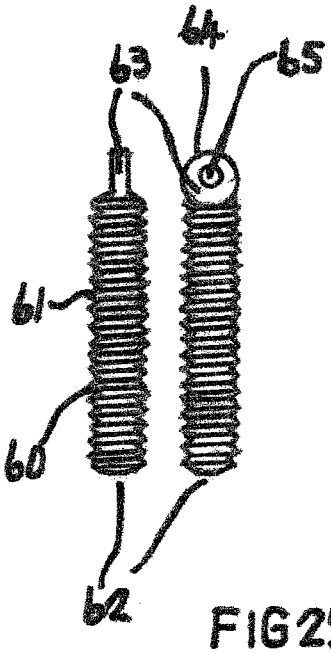
FIG 25

FIG 26
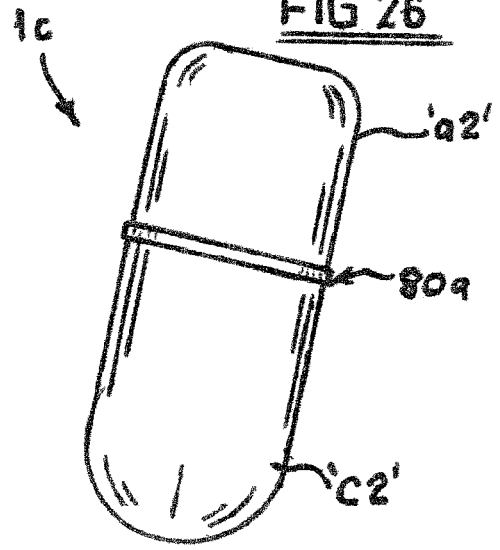
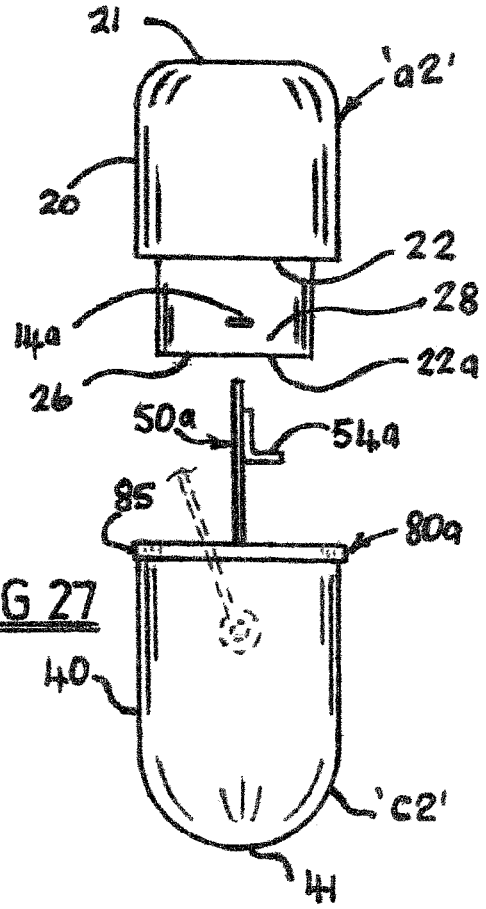
FIG 27
FIG 28
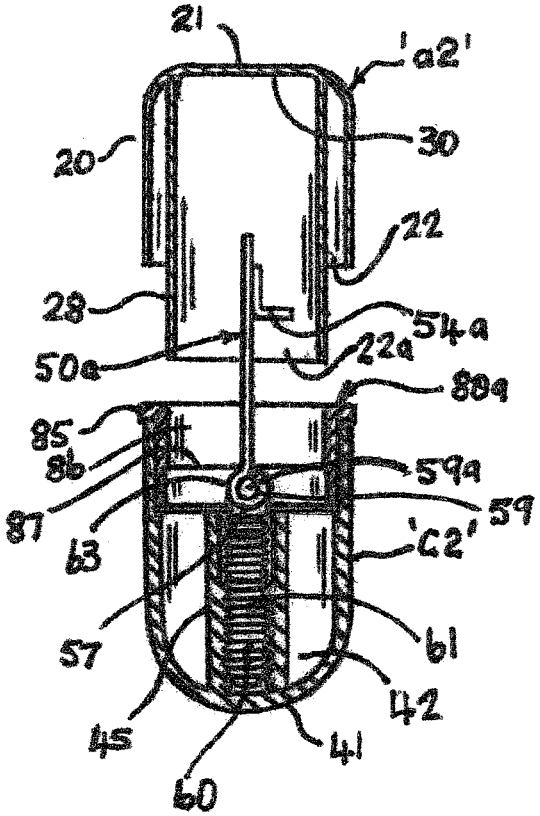
FIG 29
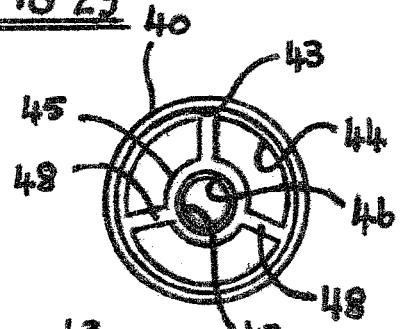
FIG 30
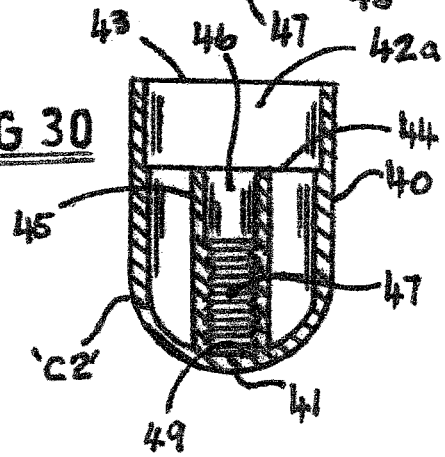

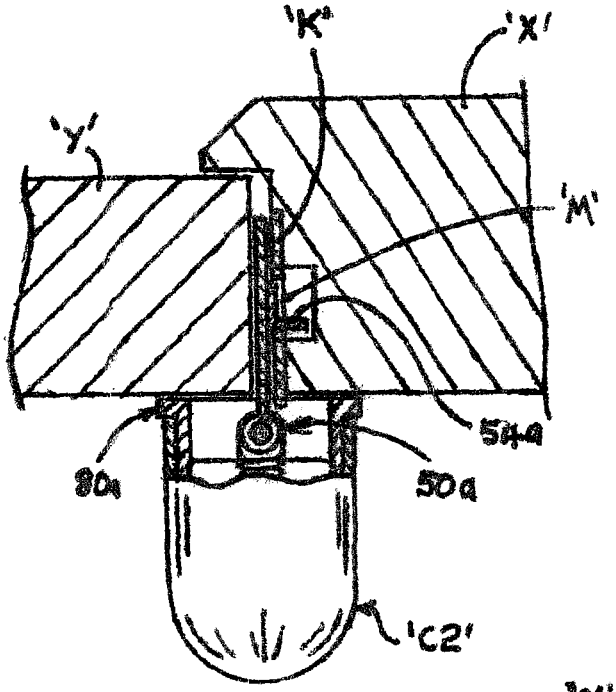
FIG 36
FIG 37
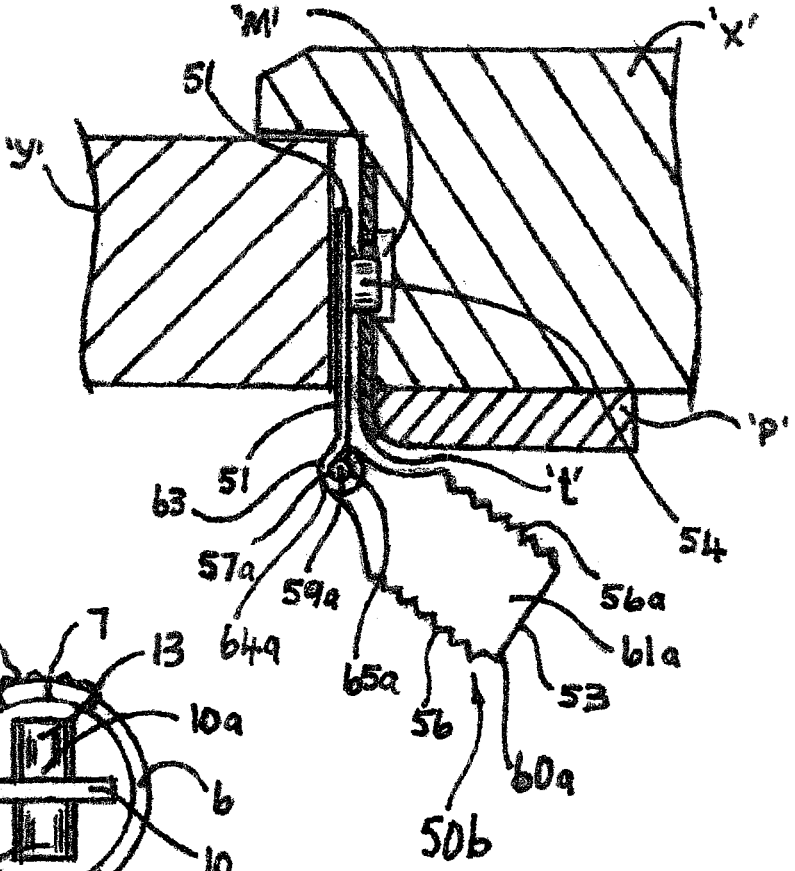
FIG 38
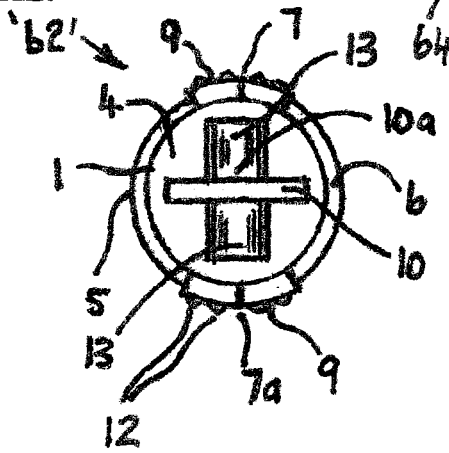

FIG 39
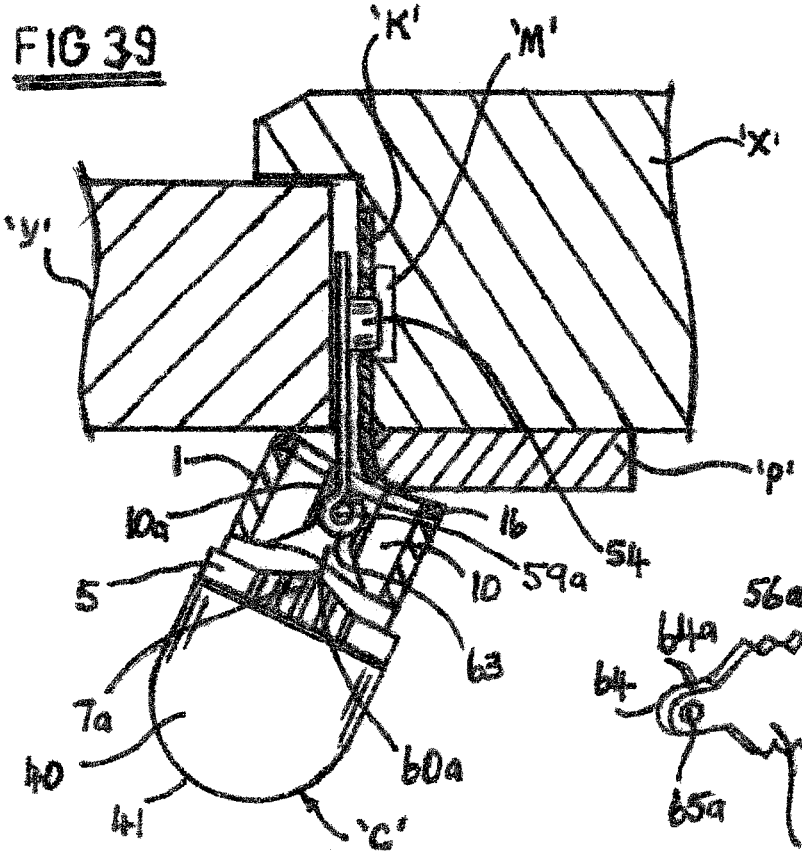
FIG 40
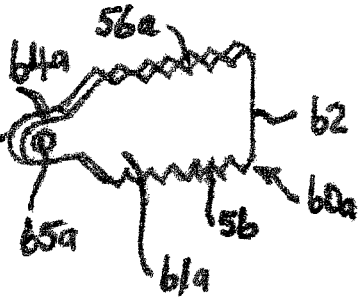
FIG 41
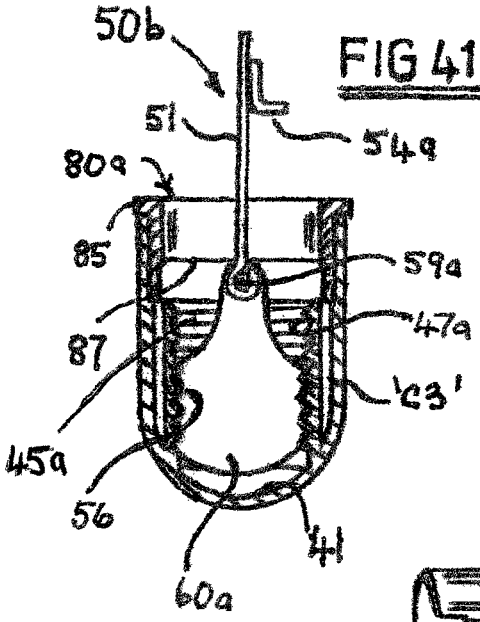
FIG 42
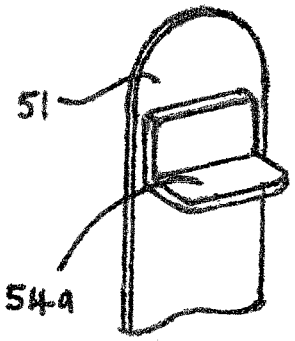
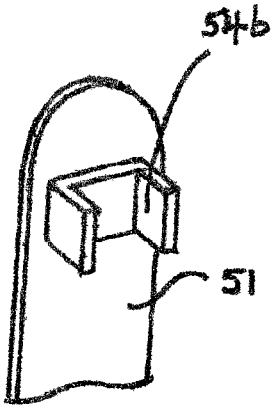
FIG 43
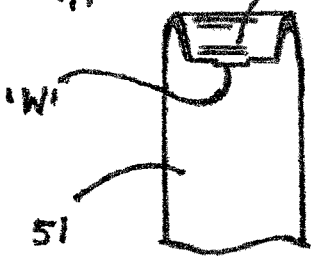
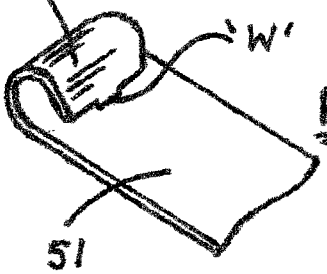
FIG 44

PORTABLE DOOR LOCK

CROSS-REFERENCE TO RELATED APPLICATIONS

This application is an U.S. national phase application under 35 U.S.C. § 371 based upon co-pending International Application No. PCT/GB2018/053017 filed on Oct. 18, 2018. Additionally, this U.S. national phase application claims the benefit of priority of co-pending International Application No. PCT/GB2018/053017 filed on Oct. 18, 2018, Great Britain Application No. 1717179.4 filed on Oct. 19, 2017, Great Britain Application No. 1717931.8 filed on Oct. 31, 2017, and Great Britain Application No. 1801138.7 filed on Jan. 24, 2018. The entire disclosures of the prior applications are incorporated herein by reference. The international application was published on Apr. 25, 2019 under Publication No. WO 2019/077360 A1.

BACKGROUND

Technical Field

The present invention relates to portable door locks which are designed to engage the strike plate of a door frame and the inner surface of a door and act to lock the door from the inside.

Background Description

Conventionally, portable locks use a thin, threaded metal bar with a hooked end, the bar locates in the gap between the opening side of the door and door frame and the hooked end locates in the latch opening in the strike plate secured to the door frame. The thin threaded bar projects outwards from the inner surface of the door to be locked perpendicular to the inner surface of the door. A blocking member is mounted on the projecting portion of the thin threaded bar, the blocking member bridges the gap between the inner surface of the door and door frame, said blocking member is locked against transverse movement on the thin bar by a threaded member, thereby, preventing the door from opening.

Devices of this general type are usually complicated or do not exert constant pressure upon the door to prevent the device rattling. Many such devices are not suitable for doors of different thicknesses, furthermore, the majority of portable locks are very mechanical in appearance and structure and not for example, suitable for a lady to carry in her handbag.

It is an object of the present invention to provide an improved portable door lock which will mitigate the above shortfalls associated with portable locks of this type, a lock that is aesthetically designed and sized to be convenient for carrying in a pocket, purse, or handbag.

SUMMARY

According to the present invention there is provided a door locking device comprising:

- a locking bar having a first section and a second section pivotally connected to the first section, the second section being provided with a protrusion; and
- a housing having a first end comprising a face and a recess provided therein;
- wherein the first section of the locking bar is received, and retained, within the recess of the housing, and

- wherein the pivotal connection is orientated with an axis of rotation that is non-parallel with the longitudinal axis of the locking bar.

Preferably, the pivotal connection is transverse with the longitudinal axis of the locking bar.

In one arrangement, the face of the housing is provided with a protective material, which may comprise one or more of: plastics material; rubber and elastomeric material; and this material may be in the form of a plug of protective material that is received within the housing and forms the face of the housing. The protective material reduces the risk of damage to the door when the device is in use by cushioning the contact area between the housing and the door.

Advantageously, a second end of the housing is substantially closed. The housing may be open at one end to receive the locking bar and closed at the other end to prevent damage to the locking bar and/or the connection between the housing and the locking bar. Additionally, the closed end of the housing prevents debris entering the housing and interfering with the device.

It is preferable that the face of the housing and the recess therein are set back from the end of the housing such that, when the locking bar is received within the recess of the housing, the pivot connection of the locking bar is positioned within the end of the housing. Having the pivot connection located within the housing provides protection to the pivot mechanism whilst also allowing the locking bar to pivot. The housing may be employed to limit the range of motion of the pivot connection.

In one embodiment, the housing comprises the first part of a connection mechanism and a lid section is provided with the lid section comprising a second part of the connection mechanism, and wherein the respective parts of the connection mechanism are engaged, at least part of the locking bar that extends from the housing is received within the lid section, and, advantageously, when the housing and lid are engaged with one another, the device is capsule in shape. The use of a lid section reduces the risk of damage to the device or to other items when the portable door locking device is not in use. For example, if the device is stored in a bag with other items, the locking bar is protected from damage by the use of a lid section and the other items in the bag are kept from damage by the lid. The use of a capsule shape, that is to say, substantially elongate with domed ends, allows the device to be well protected and an ergonomic shape that can be readily stowed in a bag or pocket.

It may be that the axial position of the protrusion of the locking bar is adjustable relative to the front face of the housing. This allows the device to be used on different door depths and sizes by allowing the distance between the housing and protrusion to be adjusted so that the distance to which the door may be opened can be altered. The adjustable distance allows a user to predetermine how far, if at all, the door can open so that they can see through the gap and determine if the door should be opened fully.

One or both ends of the locking bar may be rolled back onto itself and one or both ends may be secured thereon once rolled, with the securing, preferably, being undertaken by at least one spot weld. Doubling over the end of the locking bar and spot welding it provides further strength to the bar and reduces the risk of the parts becoming disengaged.

The invention extends to a method of locking a door, comprising the steps of:

- providing a door locking device as described herein;
- placing the protrusion of the second section of the locking bar into a recess on the door frame;

closing the door such that the locking device is positioned between the door and the door frame; and adjusting the axial position of the housing relative to the protrusion to position the housing close enough to the door to prevent it from being opened.

a portable door lock is provided which is compact and convenient to be carried from place to place by a traveller.

Preferably, the portable door lock comprises and is in the form of a small and compact tubular enclosure when it is being stowed or not in use.

BRIEF DESCRIPTION OF THE DRAWINGS

The invention will now be described further by way of example with reference to the accompanying drawings, in which:

FIG. 8 is a part cross sectional view of the door lock of FIG. 1 showing a separate rubber washer sandwiched between the lock body and face of the door, door frame, and moulding or architrave.

FIG. 9 is a cross sectional view of the lock end closure of FIG. 1 with a threaded metal insert secured therein.

FIG. 10 is a perspective view of the threaded locking bar of FIG. 1.

FIG. 11 is a perspective view of the metal threaded insert of FIG. 1.

FIG. 12 is a perspective view of the rubber washer of FIG. 8.

FIG. 16 is a perspective view of a portable lock in accordance with the present invention.

FIG. 17 is a part cross sectional view of the lock of FIG. 16 with the cover removed.

FIG. 18 is a top view of the lock body of FIG. 16.

FIG. 21 is a part cross sectional view showing the lock end closure of FIG. 16 fully screwed onto the locking bar of FIG. 19 and tightened thereon.

FIG. 22 is a cross sectional view of the lock end closure of FIG. 16 with threaded metal insert secured therein.

FIG. 23 is a side view of the flat bar element of the articulated or hinging locking bar of FIG. 16 and the locking pin or roll pin.

FIG. 24 is a side view of the locking bar of FIG. 16.

FIG. 25 shows side views of the threaded rod element of the locking bar of FIG. 16.

FIGS. 26 to 36 show an alternative arrangement which does not require the lock body component 'b1' used in the previous embodiments.

FIG. 26 is a side view of a preferred example of a portable lock in accordance with the invention.

FIG. 27 is a side view of the portable lock of FIG. 26 with the cover removed.

FIG. 28 is a part cross sectional view of the portable lock of FIG. 27.

FIG. 29 is a top view of the door lock end closure of FIGS. 26 and 30, FIG. 30 is a cross sectional view of the lock end closure of FIG. 26.

FIG. 31 is a perspective view of the protective plastic or rubber insert of FIG. 26.

FIG. 32 is a side view of the insert of FIG. 31.

FIG. 33 is a cross sectional view of the insert of FIG. 31.

FIG. 34 is a part cross sectional view showing the hinging locking bar of FIGS. 27 and 28 engaged in the aperture in the strike plate of a door frame.

FIG. 35 is a part cross sectional view showing the lock end closure 'c2' of FIG. 26 fully screwed onto the locking bar of FIG. 34.

FIG. 36 is a part cross sectional view showing the portable lock of FIG. 26 releasably secured to a door 'y' and door frame 'x', in which the door frame 'x' does not support architrave or mouldings 'p'.

FIG. 37 is a part cross sectional view showing a modified locking bar which incorporates a flat threaded plate element as an alternative to the threaded rod of FIG. 34.

FIG. 38 is a top view of the lock body of FIG. 39.

FIG. 39 is a part cross sectional view showing the lock body and lock end closure engaged on the locking bar of FIG. 37, the lock end closure is screwed tightly onto the flat threaded bar element of FIG. 40, locking the door against unwanted entry.

FIG. 40 is a perspective view of the flat threaded bar element of FIGS. 37 to 41.

FIG. 41 is a part cross sectional view showing a lock end closure 'c2.' which has been adapted to receive the flat threaded plate element of FIG. 40, utilising the modified lock end closure 'c3' eliminates the need for the lock body 'b1'.

FIGS. 42 and 43 are part perspective views showing examples of locking bars in which alternative hook projections have been attached to the locking bar by welding means.

FIG. 44 shows two part perspective views of a locking bar in which the free end of the flat bar element has been 'rolled' over to provide a hook projection which may be welded at 'w'.

DETAILED DESCRIPTION OF THE EMBODIMENTS

Figure 1:
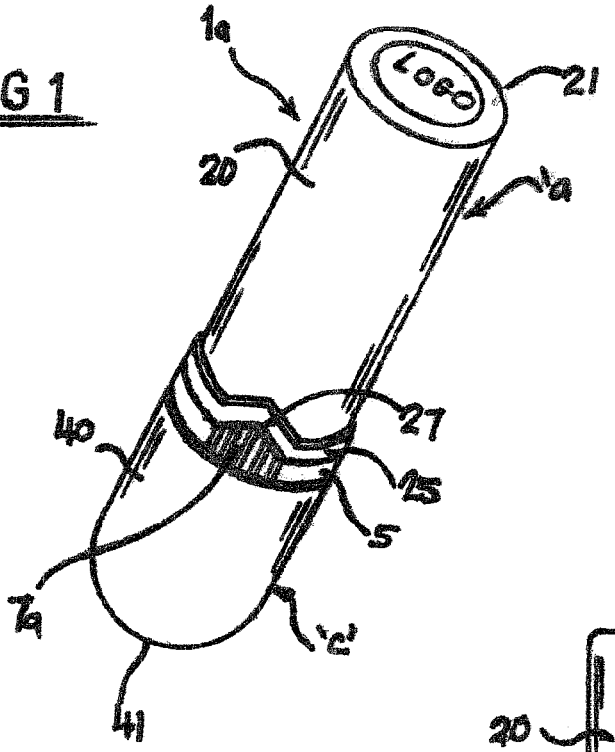
FIG. 1 is a perspective view of a portable door lock.

The portable door lock 1*a* comprises a lock body 'b', a lock end closure 'c', a lock cover 'a', a thin walled metal threaded locking bar 50, a threaded metal insert-nut and a rubber washer.

The lock body 'b' comprises a short annular rod 1 fabricated from metal or suitable plastic material, the bottom end 3 of the body 1 defines a shallow annular flange 5, a pair of inclined ramps 7 and 7*a* extend from the inner face 6 of the flange 5 said ramps 7 and 7*a* are spaced 180 degrees apart on the flange 5. The ramps 7 and 7*a*, in use, interengage respectively, cooperating angled surfaces 27 and 27*a* in the front face 26 of the open end 22 of the lock cover 'a'. The top end 4 of the lock body 1 defines a large chamfer 4*b* which allows the top end of the body 1 to clear or avoid any raised mouldings 'p' [or architrave] that may be fixed to the door frame 'x', a narrow slot or aperture 10 extends through the centre of the lock body 1, said aperture 10 corresponding with the thickness and width of the threaded locking bar 50. The sides 9 and 9*a* of the ramps 7 and 7*a* protrude slightly outward of the flange 5 and define a number of raised, vertical grip beads 12. A pair of raised horizontal beads 14 and 14*a* are provided on the lock body 1 and are spaced rotationally, 180 degrees apart. A coating of rubber or suitable yielding material 16 may be applied to the surface of the front end 4 of the lock body 'b' including the chamfered area 4*b*.

The lock cover 'a' comprises a thin walled, tubular plastic cover having a body 20 with a closed top end 21 the other open end 22 of the cover 'a' defines a flange 25 which has a pair of two sided angled cut-outs 27 and 27*a* defined in the front face 26 of the flange 25 said pair of cut-outs 27 and 27*a* are spaced rotationally, 180 degrees apart, FIG. 1 shows the lock 1*a* in carrying mode, fully assembled and prior to use and best illustrates how the two sided spaced apart ramps 7 and 7*a* on the lock body 1 nest within their respective angled recesses 27 and 27*a* in the flange 25 on the lock cover 'a'.

The interengagement of the ramps 7 and 7*a* and cut-outs 27 and 27*a* assist in the removal of the lock cover 'a' from the lock body 'b', twisting the lock cover 'a' relative to the lock body 'b' cause the ramps 7 and 7*a* to drive the lock cover 'a' outwards and away from the lock body 'b' and the raised beads 29 and 29*a* on the inside wall of the cover 'a' [ref FIG. 17], respectively, to be forced over the raised beads 14 and 14*a* on the lock body 1, when the lock cover 'a' can then be easily removed.

The lock end closure 'c' comprises a thin walled tubular plastic cap having a body 40 and a closed back end 41 which is preferably domed, the open front end 42 of the body 40 permits a large diameter coarse threaded metal insert nut 70 to be fixedly secured within the hollow body 40, the metal insert 70 may be secured in the lock end closure 'c' during the plastic moulding process, alternatively, said metal insert 70 may be fixed within the lock body 40 after the moulding process by ultrasonic welding or heat pressing means.

The threaded locking bar 50 comprises a main body 51 in the form of a thin walled threaded metal bar, a dome like projection 54 is defined centrally and adjacent the front end 52 thereof which is integral to the locking bar 50 and formed by a drawing or pressing process, said projection 54 acts as a hook that engages in the aperture 'm' in the strike plate 'k' which is secured to the door frame 'x'. The thin locking bar 50 is threaded, its threaded portions 56 and 56*a* are very coarse and correspond with the internal coarse thread 74 in the metal insert nut 70, the screw threads 56 and 56*a* are provided on the side edges of the locking bar 50 and extend from its back end 53 to approximately one third the length of its body 51.

The lock body 1 is slidably mountable on the threaded locking bar 50 by means of the transverse aperture or slot 10 which extends through the centre of the lock body 1. The width of the body 51 of the locking bar 50 is reduced slightly toward its front end 52 to provide a pair of stop faces 55 and 55*a* which, in use, abut the outer surface of the top end 4 of the lock body 1 to limit how far the locking bar 50 may extend through the narrow aperture or slot 10 [this is for stowage purposes, ref FIG. 2], a transverse stiffening rib 58 is defined centrally in the locking bar 50, said rib 58 extends from adjacent the back end 53 of the threaded bar 50 to approximately its centre. The locking bar 50 is preferably fabricated from stainless steel.

The metal insert nut 70 comprises a tubular body 71 which has shallow annular grooves 75, barbs and knurling defined in its outer surface 72, the inner wall 73 of the insert nut 70 defines a very coarse thread 74 that corresponds with the threads 56 and 56*a* on the locking bar 50. The threaded insert 70 may protrude 0.25 mm past the front end 42 of the lock end closure 'c' to prevent any force applied to the door 'y' being transferred to the body 40

A rubber washer 80 is provided having a generally oval shaped body 81 and defining an off centre aperture or slot 83 sized to loosely receive the locking bar 50. The washer 80 is fabricated from a reinforced rubber material and is mounted on the locking bar 50 to locate on the front end 4 of the lock body 1. The rubber washer 80 will deform to accommodate various profiles on mouldings 'p' and act to protect the surface of the door 'y', door frame 'x' and mouldings 'p' from scuffing or damage. Preferably, the washer 80 is stowed on the locking bar 50 as shown in FIG. 8 or alternatively inside the lock cover 'a'.

Figure 4:
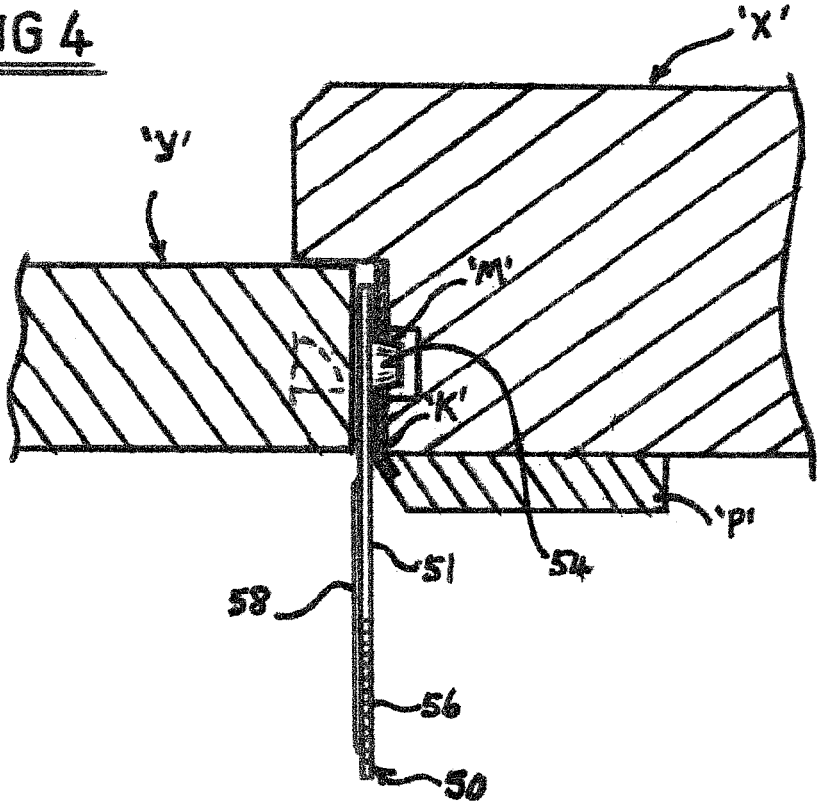
FIG. 4 is a part cross sectional view showing the locking bar of FIG. 1 engaged in the aperture in the strike plate on the door frame.
Figure 5:
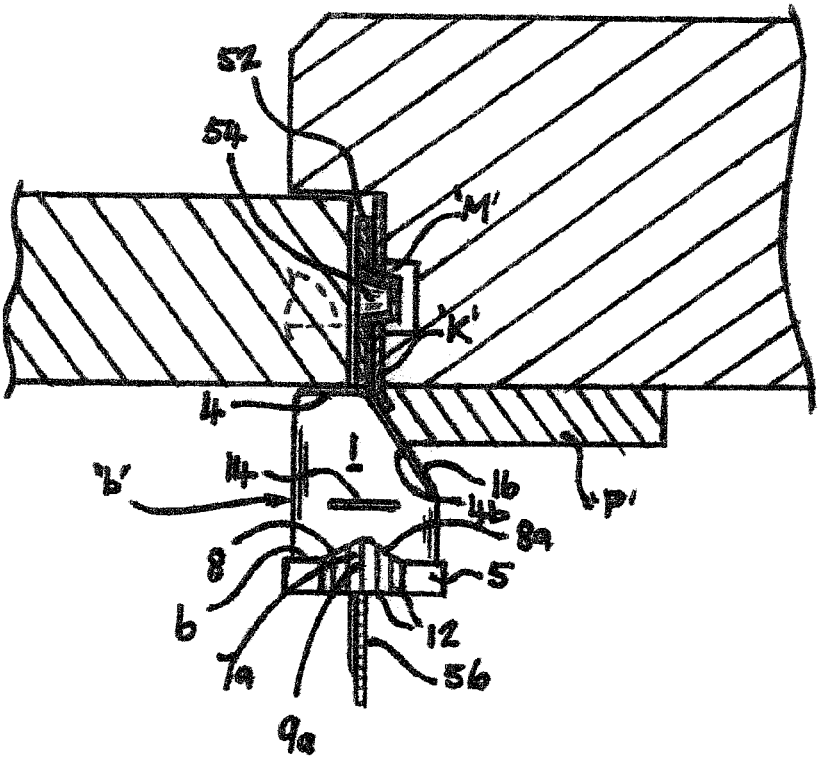
FIG. 5 is a part cross sectional view showing the lock body of FIG. 1 engaged on the locking bar of FIG. 4.
Figure 6:
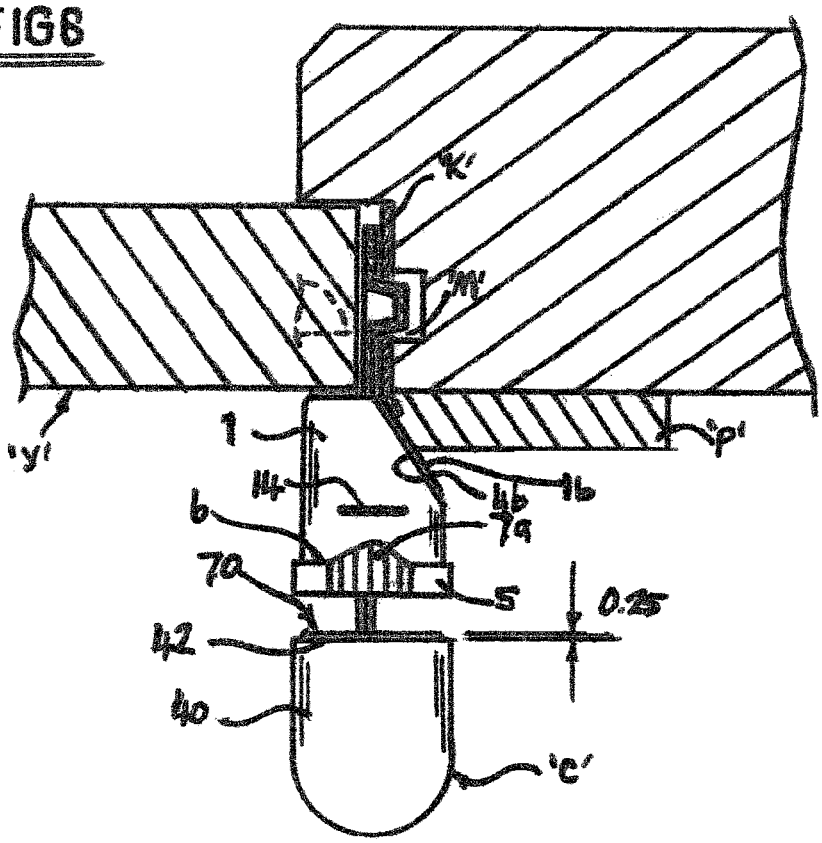
FIG. 6 is a part cross sectional view, when the end closure of FIG. 1 has been partially screwed onto the locking bar of FIG. 4.
Figure 7:
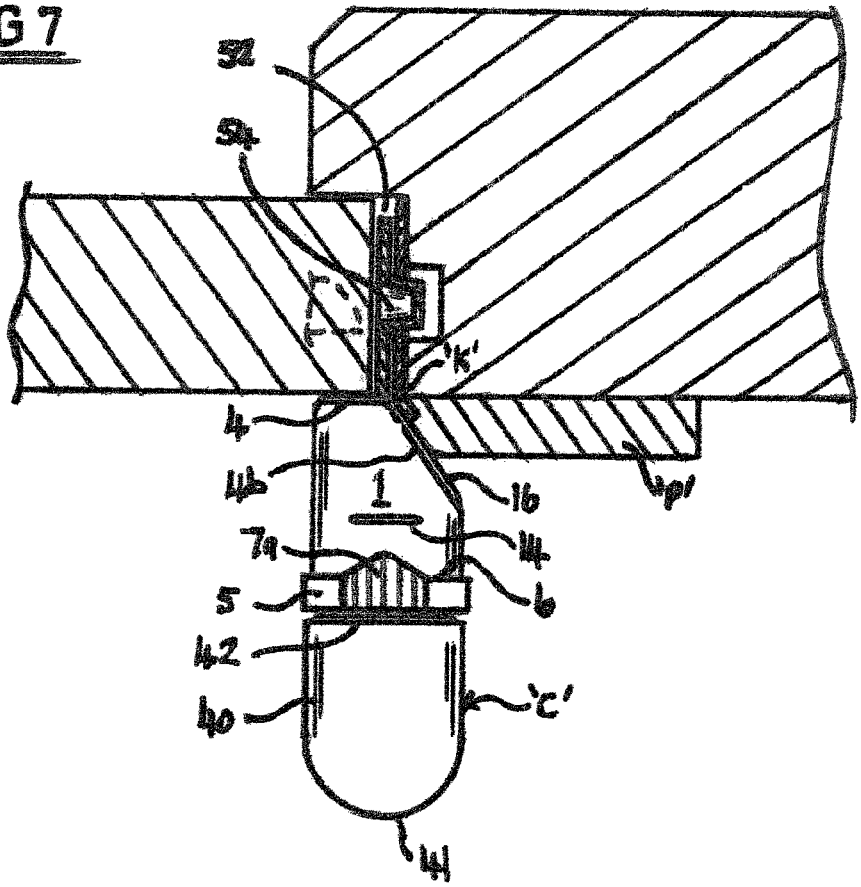
FIG. 7 is a part cross sectional view showing the end closure of FIG. 1 fully screwed onto the locking bar of FIG. 4 and tightened thereon, the portable door lock is operational, locking the door.

Referring now to the drawings, FIGS. 7 and 8 show the lock of FIG. 1 securely attached to a door 'y' and door frame 'x' effectively locking the door 'y'. FIG. 4 best illustrates the first stage of engagement of the door lock 1*a*, when the projection 54 on the threaded locking bar 50 is engaged in the aperture 'm' in the strike plate 'k' which is secured to the door frame 'x', the door 'y' is closed. The lock body 'b' is then engaged on the threaded locking bar 50 [ref FIG. 5] and moved thereon to abut the inner surface of the door 'y' and the door frame 'x', the lock end closure 'c' containing the internally threaded metal insert 70 is then engaged on the threaded bar 50 by means of its threaded portions 56 and 56*a* which combine to provide a thread that is compatible with the thread 74 of the metal insert 70, [ref FIG. 6], the lock end closure 'c' is then screwed further onto the threaded bar 50 until it abuts the lock body 'b' [ref FIGS. 7 and 8]. The lock end closure 'c' is then tightened on the threaded bar 50 when the portable door lock 1*a* is then in its operational condition, locking the door 'y' against unwanted entry. Any force applied from outside the door 'y' will be rigidly resisted by the engagement of the threaded insert 70 on the threaded bar 50 and the engagement of the projection 54 on said threaded bar 50 in the aperture 'm' in the strike plate 'k' which is fixedly secured to the door frame 'x'. To remove the portable lock 1*a* from the door 'y' the above procedure is reversed.

Figure 2:
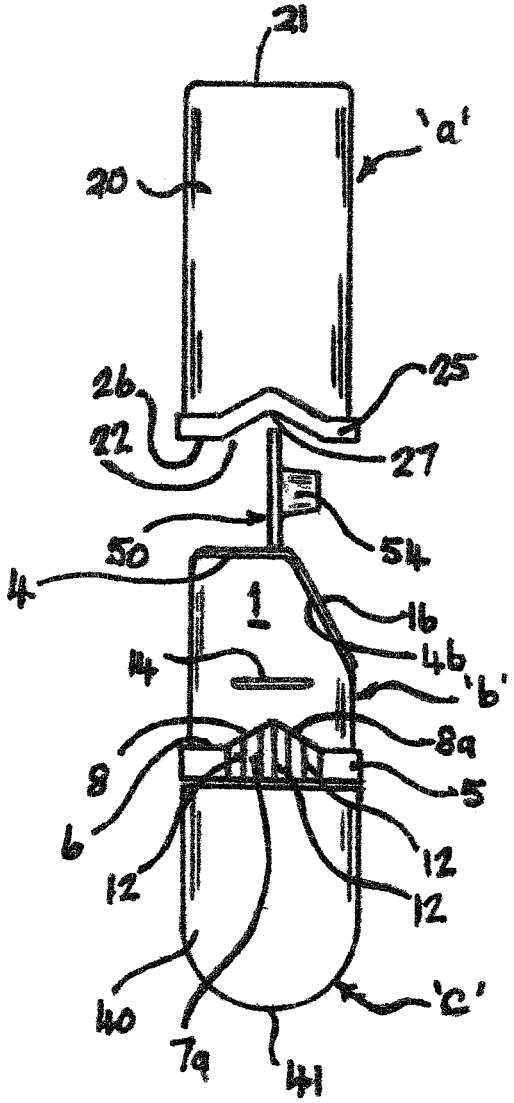
FIG. 2 is a side view of the portable door lock of FIG. 1 with the cover removed.
Figure 3:
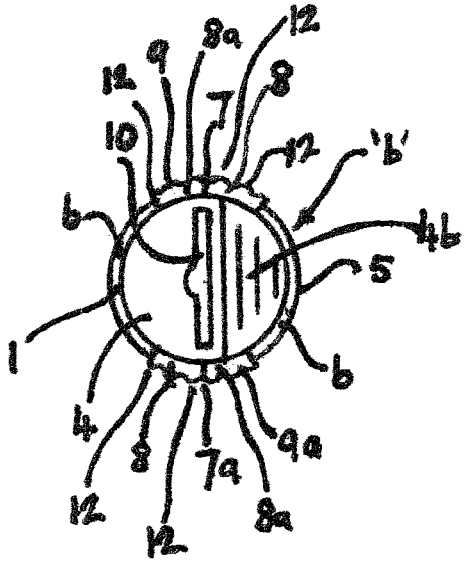
FIG. 3 is a top view of the lock body of FIG. 1.

To assemble the portable door lock 1*a* for stowage or transportation, [ref FIG. 2]. Whilst holding the lock body 'b' upright, insert or drop the threaded bar 50 by its back end 53, through the narrow aperture or slot 10 in the top end 4 of the lock body 'b', when stop faces 55 and 55*a* on the edges of the threaded bar 50 will abut the front end 4 of the lock body 'b', the lock end closure 'c' may then be screwed onto the back end 53 of the threaded bar 50 [which is protruding from the bottom end 3 of the body 'b'] until said lock end closure 'c' abuts the lock body 'b', when it is lightened thereon. The lock cover 'a' may then be pushed onto the lock body 'b' whilst simultaneously aligning the pairs of ramps 7 and 7*a* on the body 'b' respectively with the cut-outs 27 and 27*a* in the lock cover 'a', when the pair of raised, horizontal beads 29 and 29*a* [not shown and which are spaced 180 degrees apart] defined on the inside face of the lock cover 'a' will ride over respectively, the raised beads 14 and 14*a* defined on the surface of the lock body 1, said pairs of beads acting to retain the lock cover 'a' on the lock body 'b'.

The lock cover 'a' is removed by turning it relative to the lock body 'b', which causes the ramps 7 and 7*a* on the body 'b' to drive the lock cover 'a' outward and away from the lock body 'b' and the beads 29 and 29*a* respectively, to ride back over the raised beads 14 and 14*a* on the lock body 'b' when the lock cover 'a' can then easily be fully removed.

Figure 13:
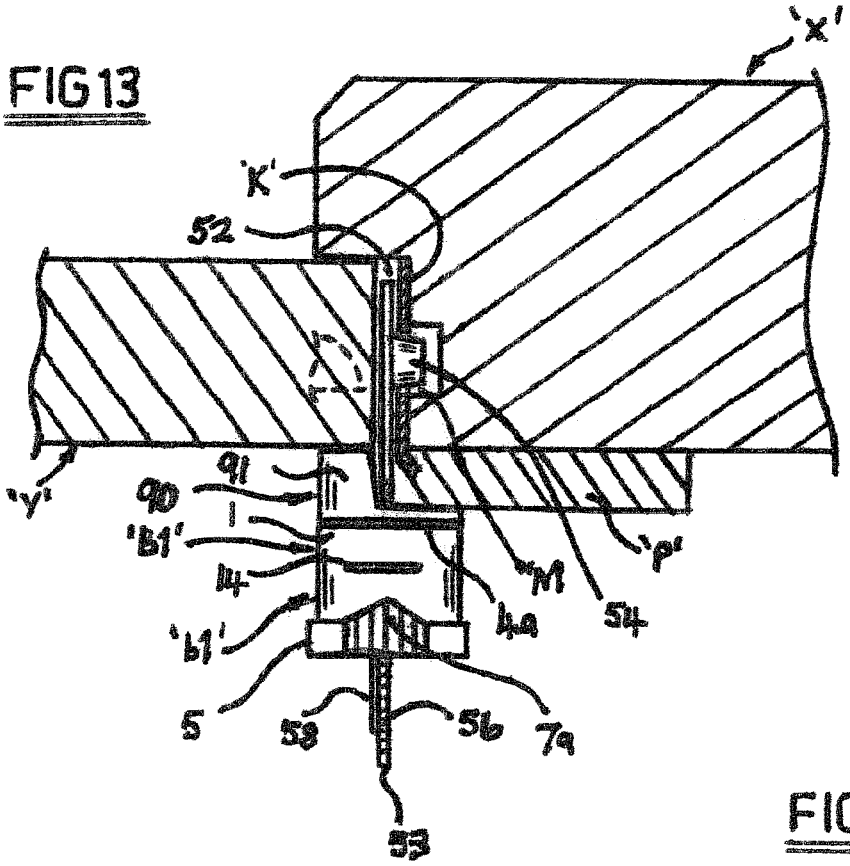
FIG. 13 is a part cross sectional view illustrating a modified lock body adapted for use with a stepped rubber washer.
Figure 14:
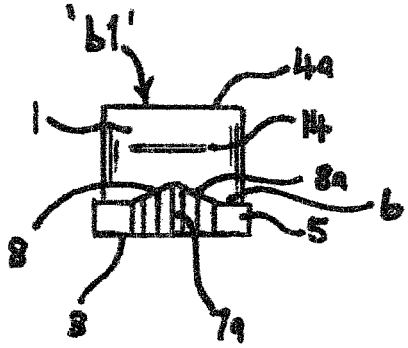
FIG. 14 is a side view of the lock body of FIG. 13
Figure 15:
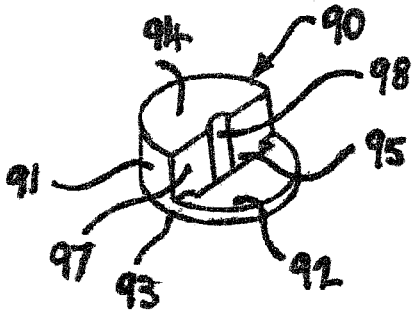
FIG. 15 is a perspective view of the stepped washer of FIG. 13.
Figure 19:
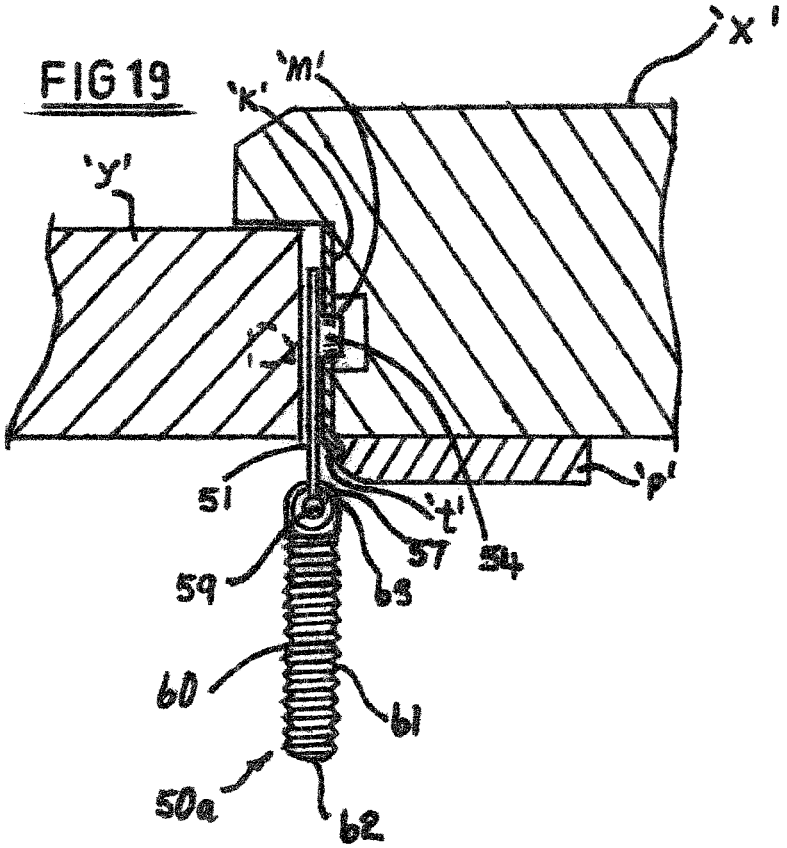
FIG. 19 is a part cross sectional view showing the hinging locking bar of FIG. 16 engaged in the aperture in the strike plate of the door frame.
Figure 20:
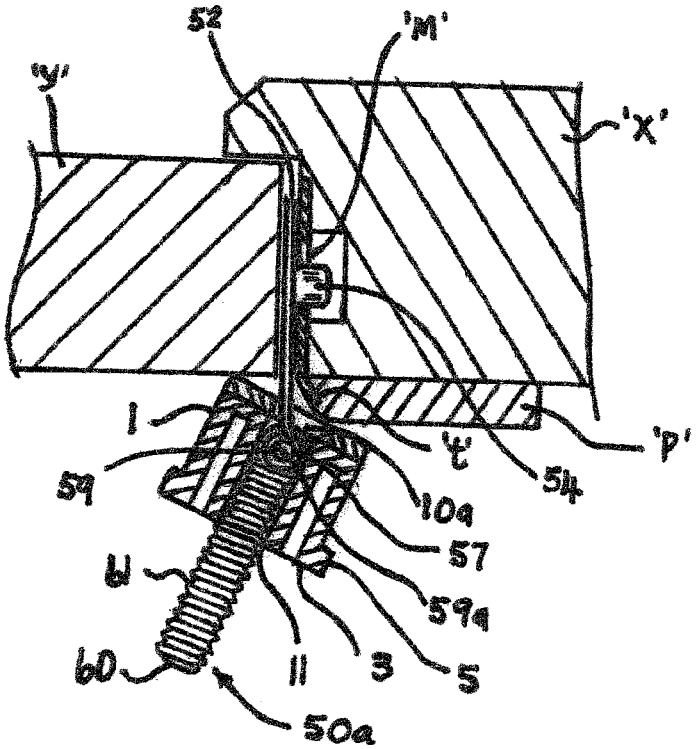
FIG. 20 is a part cross sectional view showing the lock body of FIG. 16 engaged on the locking bar of FIG. 19 and abutting the door and frame.
Figure 32:
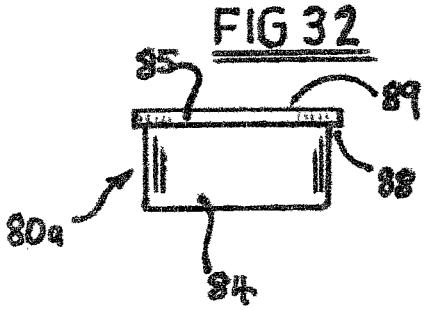
Figure 31:
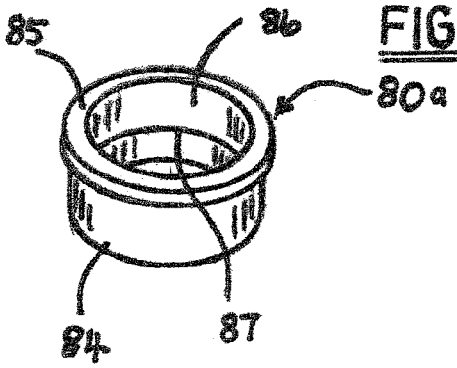
Figure 33:
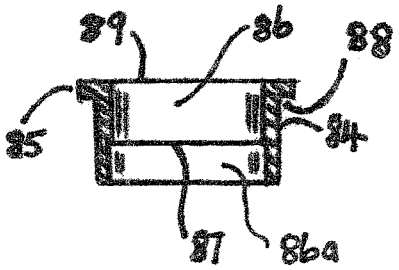

Referring now to FIGS. 13 to 15 which illustrate an alternative arrangement in which a modified lock body 'IA' is provided which has a flat front end 4*a*. A stepped rubber washer 90 is secured to the front end 4*a* of the lock body 1 by means of its back end 93, a central aperture or through slot 95 is provided in the lower portion 92 of the washer 90 and sized to loosely receive the locking bar 50. FIG. 15 is a part cross sectional view showing the lock body 'b1' slideably mounted on the locking bar 50 which is engaged in the aperture 'm' in the strike plate 'k' by means of its projection 54, the upper front surface 94 of the rubber washer 90 is abutting the surface of the door 'y' and the lower surface 92 of the washer 90 is abutting the moulding or architrave 'p'. When the lock end closure 'c' is screwed onto the locking bar 50 to abut the lock body 'b1', the door 'y' will be locked against unwanted entry. The cut-out 98 in the washer 90 accommodates the rib 58 on the locking bar 50.

Alternatively, the washer 90 may be provided as a separate component and may be stowed on the locking bar 50, as there may be occasions when a door frame 'x' is not supporting moulding or architrave 'p'. A facing of rubber or other suitable yielding material 16, not shown, may be applied to the surface of the front end 4 of the lock body 1, All other aspects of this alternative arrangement are similar to the embodiment of FIGS. 1 to 12.

Referring now to FIGS. 16 to 25 which illustrate a second embodiment of the invention in which a locking bar 50*a* incorporates a hinging or pivoting element. A short threaded bolt 60 is swivalably secured to the back end 53 of the threaded bar 50*a*, this arrangement allows the lock body 'b1' and lock end closure to pivot relative to the flat bar 51 of the locking bar 50*a*, when mounted on the threaded bolt 60, this allows the front end 4 of the lock body 1 to better bridge the uneven surface defined between the door 'y' and the moulding 'p' secured to the door frame 'x' [ref FIGS. 20 and 21]. If moulding 'p' is not present the body 1 will simply bridge the gap between the door 'y' and door frame 'x' and the threaded bar 50*a* will be parallel, the front end 4 of the lock body 1 will also bridge the gap between the door 'y' and the tongue 't' of the strike plate 'k'.

The articulated locking bar 50*a* is easier to install where space is limited. FIG. 21 shows the portable lock of FIG. 16 securely attached to a door 'y' and door frame 'x' effectively locking the door 'y' against unwanted entry, FIG. 19 best illustrates the first stage of engagement of the door lock 1*b*, when the projection 54 on the locking bar 50*a* is engaged in the aperture 'm' in the strike plate 'k', the door 'y' has been closed trapping the locking bar 50*a*, the lock body 'b1' is then slidably mounted on the locking bar 50*a* [ref FIG. 20], and moved thereon to abut the inner surface of the door 'y' and moulding 'p', the lock end closure 'c1' supporting the threaded metal insert 70 is then screwed onto the free end 62 of the threaded bolt 60 of the locking bar 50*a* [which protrudes through the aperture 11 in the back end 3 of the lock body 1], until its front end 42 abuts the back end 3 of the lock body 1, the end closure 'c1' is then tightened on the locking bar 50*a* when the portable door lock 1*b* is in its operational condition, locking the door 'y' against unwanted entry. Assembly of the portable door lock has been described above in FIGS. 1 to 15.

The lock body 'b1' is very similar to the body of FIGS. 1 to 15, it supports a flange 5, the ramps 7 and 7*a* etc. The body 'b1' defines a large rectangular, deep bore 10*a* which extends from its front end 4 to adjacent its back end 3, the end of the bore 10*a* defines a radius 13, an aperture 11 is provided centrally in the back end 3 of the body 'b1' said aperture 11 intersects the bore 10*a*, The aperture 11 is to receive the threaded bolt portion of the locking bar 50*a*.

The lock cover 'a1' is almost identical to that of FIG. 2, the only difference is the lock cover 'a1' does not have the flange 25. In FIG. 17 the horizontal ribs 29 and 29*a* are visible.

The lock end closure 'c1' of FIG. 22 is almost identical to that of FIG. 9, the only difference is the threaded insert 70 has a smaller diameter than that of FIG. 9.

The threaded locking bar 50*a* comprises a main body 51 in the form of a thin walled metal bar, an integrally formed projection 54 is defined adjacent its front end 52 said projection 54 acts as a hook that engages in the aperture 'm' in the strike plate 'k' which is secured to the door frame 'x', the back end 53 of the main body 51 is rolled 360 degrees to provide an enclosure 59 to receive a locking pin 59*a*, a short slot 53*a* is provided centrally in the back end 53 of the main body 51 said slot 53*a* extends inwards of the body 51 sufficient to provide a location for the reduced end 63 of a threaded bolt 60, said reduced end 63 defines a full radius 64 and an aperture 65 is defined centrally in the reduced end 63, said aperture 63 to receive the locking pin 59*a*. The reduced end 63 of the threaded bolt 60 engages or locates in the slot 53*a* to align its aperture 65 with the pair of apertures 59 [in dotted outline] created by the rolled ends 57 and 57*a* in the back end 53 of the main body 51. When the locking pin [or roll pin] 59*a* is inserted through the aligned apertures 57, 65 and 57*a* to hingingly secure the threaded bolt 60 to the main body 51 to complete the assembly of the locking bar 50*a* [ref FIG. 24]. If required, the ends of the locking pin 59*a* may be welded 'w' respectively, to the rolled ends 57 and 57*a* of the metal bar 1 to provide additional strength to the threaded locking bar 50*a*

The lock body 'b1' is slideably mountable on the locking bar 50*a* by means of the aperture 11 defined in the bottom end 3 of the lock body 1, the rolled ends 57 and 57*a* of the locking bar 50*a* will locate and nest in the radiused end 13 of the rectangular bore 10*a*.

A coating of rubber or other suitable yielding material 16 may be applied to the outer surface of the top end 4 of the lock body 'b1', alternatively, a loose rubber washer 80 may be provided which is mountable on the locking bar 50*a*, said washer 80 to be trapped between the top end 4 of the lock body 'b1' and the door 'y' and door frame 'x', the washer 80 will deform to accommodate various profiles on mouldings 'p' and act to protect the surfaces of the door 'y', door frame 'x' and mouldings 'p' from scuffing or damage. Preferably, the washer 80 is stowed on the locking bar 50*a*, as shown in FIGS. 17 and 21 or inside the lock cover 'a1'.

Referring now to FIGS. 26 to 36 which describe an alternative arrangement in which the lock body 'b1' of the previous embodiment is not required.

The portable door lock 1*c* in this example comprises an end closure 'c2', a lock cover 'a2', a threaded locking bar 50*a* and a plastic or rubber insert 80*a*.

Figure 34:
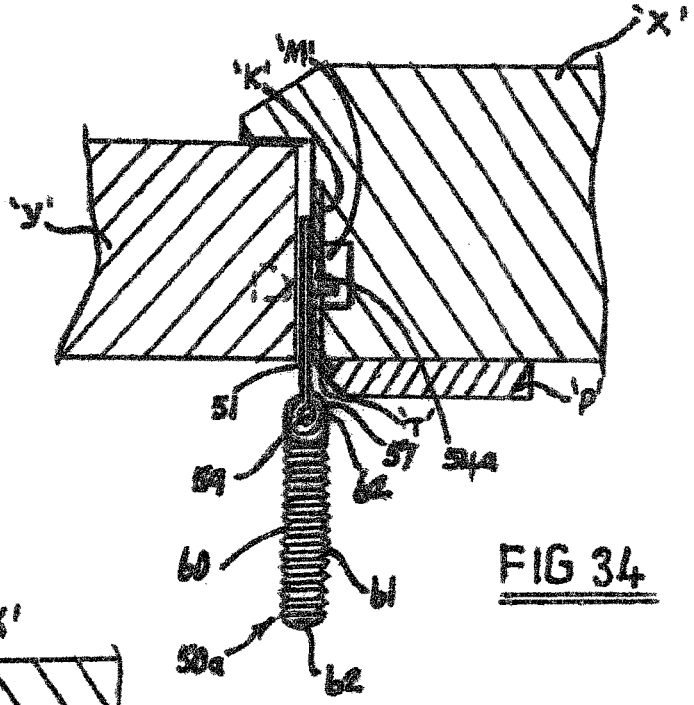
Figure 35:
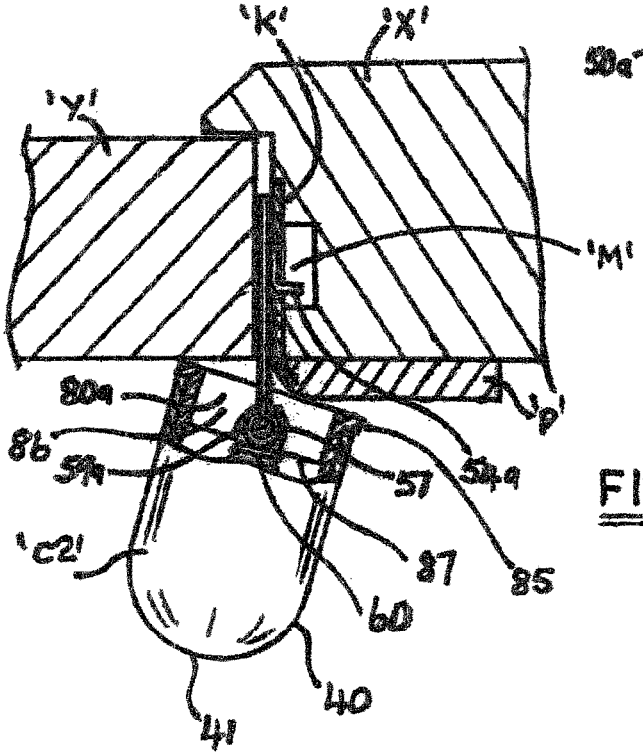

FIGS. 34 and 35 best illustrate the application of the portable lock 1*c*, FIG. 34 shows the first stage of releasably engaging the lock 1*c* to a door 'y' and door frame 'x', FIG. 34 shows the locking bar 50*a* trapped between the door 'y' and door frame 'x', by means of its hook projection 54*a* which is engaged in the aperture 'm' in the strike plate 'k' which is secured to the door frame 'x'. The lock end closure 'c2' which supports an internal screw thread 47 [ref FIG. 35] is then screwed onto the free end 62 of the threaded bolt element 60 of the locking bar 50*a* until the plastic or rubber insert 80*a* secured in the front end of the lock end closure 'c2' abuts the inner surface of the door 'y' and architrave or moulding 'p', the lock end closure 'c2' is then tightened on the locking bar 50*a* when the portable door lock 1*c* is in its operational condition, locking the door 'y' against unwanted entry. The illustrated locking bar 50*a* defines an alternative hook projection 54*a* [ref FIGS. 27, 28 and 42].

In this arrangement, the plastic or rubber insert 80*a* is a force fit into the open end 42 of the lock end closure 'c2' said closure 80*a* acts to protect the surfaces, respectively, of the door door frame 'x' and mouldings 'p' from scuffing or damage from the lock end closure 'c2' which may be fabricated from metal. The lock cover 'a2' is preferably a push, interference fit into the plastic or rubber insert 80*a* by means of its inner body element 28.

The lock end closure 'c2' [ref FIGS. 29 and 30] comprises a thin walled, preferably metal cylindrical enclosure 40 which has a closed back end 41 which may be domed, the front end 43 of the end closure 'c2' is open, the inner surface 42 is reduced in diameter adjacent its open end 43 said reduced diameter 42*a* provides an annular step 44, said reduced wall thickness 42*a* and step 44 are to locate the plastic or rubber insert 80*a* [ref FIG. 28]. A tubular boss 45 extends centrally from the inside base 49 of the end closure 'c2' outwardly thereof to the level of the annular step 44, said boss 45 defines a central bore 46 which supports an internal screw thread 47 which extends from the bottom 49 of the bore 46 to approximately two thirds of its length, the thread 47 is to engage with the threaded rod element 60 of the locking bar 50*a*. The screw thread 47 is preferably formed as an integral part of the end closure 'c2' which may be produced as a die cast moulding, alternatively, the screw thread 47 may be formed or cut in a second operation after the moulding process, or a metal threaded insert may be secured in the end closure 'c2'. A number ribs 48 extend from the inside surface 42 of the end closure 'c2' to the boss 45 to provide internal support.

The lock cover 'a2' [ref FIGS. 27 and 28] comprises a thin walled, preferably metal or plastic cylindrical enclosure 20 having a closed back end 21, its front end 22 is open, a tubular boss 28 extends centrally from the inside base 30 of the lock cover 'a2' outwardly thereof to extend past the front open end 22 of the lock cover 'a2' a measure that provides that the end 22*a* of the boss 28 will locate adjacent the step 44 within the lock end closure 'c2' when the lock cover 'a2', in use, is secured thereon. A number of spaced, raised beads 14, 14*a* and 14*b* may be defined on the outer surface of the boss 28 said beads, in use, engage behind the step or undercut 87 defined in the inner surface 86 of the plastic or rubber insert 80*a* to provide slight resistance to removal of the lock cover 'a2' from the lock end closure 'c2'.

The plastic or rubber insert 80*a*, which may be optional, may comprise a tubular moulding having a main body portion 84 its top end 89 defines a narrow flange 85 which has a diameter that is slightly larger than the outside diameter of the lock end closure 'c2', the insert 80*a* is a force fit into the lock end closure 'c2' when the inside surface 88 of the flange 85 abuts the open end 43 of the lock end closure 'c2'. A counter bore 86*a* is provided in the inside wall 86 forming a step or undercut 87 which, in use, engages the raised beads 14, 14*a* and 14*b* defined on the boss 28 of the lock end closure 'a2'. The plastic or rubber insert 80*a* may be moulded or manufactured from glow in the dark material.

FIG. 35 shows the portable door lock 1*c* in its operative condition in which position the lock end closure 'c2' is not parallel with the main body element 51 of locking bar 50*a*, the lock end closure 'c2' is abutting the inner surface of the door 'y' and the outer surface of the architrave 'p'. The lock end closure 'c2' may hinge or pivot 40 degrees on the threaded bolt 60 relative to said main body element 51 in order to accommodate various thicknesses of architrave or moulding 'p'.

FIGS. 27 and 28 show the door lock 1*c* with the lock cover 'a2' removed, the threaded locking bar 50*a* is in its lower fully stowed position in the lock end closure 'c2' in which it is screwed fully onto the threaded bolt 60 of the locking bar 50*a*, the rolled over ends 57 and 57*a* of said main body element 51 are abutting the top of the boss 45 in the lock end closure 'c2'. When the components are in this position the lock cover 'a2' may be applied [ref FIG. 26].

FIG. 36 shows the door lock 1*c* secured to a door 'y' and a door frame 'x' that does not support architrave or moulding 'p' in this example the lock end closure 'c2' is parallel with the threaded locking bar 50*a*.

Referring now to FIGS. 37 to 40 which illustrate an alternative arrangement in which the locking bolt element 60 of the locking bar 50*a* has been replaced with a flat threaded bar element 60*a*.

The flat threaded bar element 60*a* of the articulated locking bar 50*b* [ref FIG. 40] comprises a generally rectangular body 61*a*, the front end 64 the body 61*a* is reduced in width to provide a tongue 64*a* with a radiused end 64, an aperture 65*a* is provided centrally in the tongue 64*a* to receive the locking pin 59*a*. The tongue 64*a* of the body 61*a* engages or locates in the slot 53*a* in the 'rolled' back end 53 of the main body 51 of the locking bar 50*a* to align its aperture 65*a* with the pair of apertures 59 [in dotted outline ref FIG. 23] created by the rolled ends 57 and 57*a*. When the locking pin [or roll pin] 59*a* is inserted through the aligned apertures 57, 65*a* and 57*a* to pivotally secure the threaded bar element 60*a* to the main body 51 to complete the assembly of this alternative locking bar 50*b*.

FIG. 37 shows the alternative threaded locking bar when the projection 54 is engaged in the aperture 'm' in the strike plate 'k', the door 'y' has been closed trapping the locking bar Sob. The lock body 'b2' is slideably mountable on the locking bar 50*b* by means of the narrow transverse slot or aperture 10 which extends through the lock body 1, the rolled ends 57 and 57*a* of the locking bar ═b will locate and nest in the radiused end 13 of the rectangular bore 10*a* when the portable door lock 1*b* is assembled for stowage.

FIG. 39 shows the lock body 1 mounted on the locking bar 50*b* and abutting the inner surface of the door 'y' and moulding 'p', the lock end closure supporting the large diameter threaded metal insert 70 has been screwed onto the threaded bar element 60 of the locking bar 50*b* until its front end 42 abuts the back end 3 of the lock body 1, the end closure 'c' has been tightened on the locking bar 50*b* and the portable door lock 1*b* is in its operational condition, locking the door 'y' against unwanted entry. Assembly of the portable door lock has been described above in FIGS. 1 to 15.

FIG. 38 is a top view of the lock body 'b2' clearly showing the narrow slot 10 to receive the threaded bar element 60*a*, in this example, the top end 4 of the body 1 is curved inwards. All other aspects of the lock body 'b2' are identical to that of the previous embodiment of FIGS. 16 to 25.

FIG. 40 is a perspective view of the threaded bar element 60*a* of the locking bar 50*b* of FIGS. 37 and 39.

FIG. 41 shows the lock end closure 'c2' [ref FIGS. 29 and 30] which has been modified to receive the flat threaded plate element 60*a* of FIG. 40, this modified lock end closure 'c3' defines a central boss 45*a* with a very course internal screw thread 47*a* which corresponds with the course thread 56 on the plate element 60*a* on the locking bar bob. The lock body 'b' of FIGS. 37 to 40 is not required when using the lock end closure 'c3'.

FIGS. 42 and 43 illustrate two examples of the main body 51 of locking bars which have hook projections 54*a* and 54*b* respectively attached to said main bodies 51 by welding means.

FIG. 44 shows two views of a locking bar main body 51 in which the free end of said bar 51 has been 'rolled' over to provide a hook projection 54*c* which may be welded at 'w', The same numerals have been used throughout this specification to denote similar components.

Figure 45:
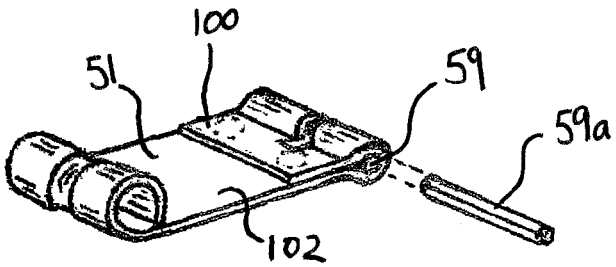
FIGS. 45 to 47 show part of a portable lock according to the present invention.
Figure 46:
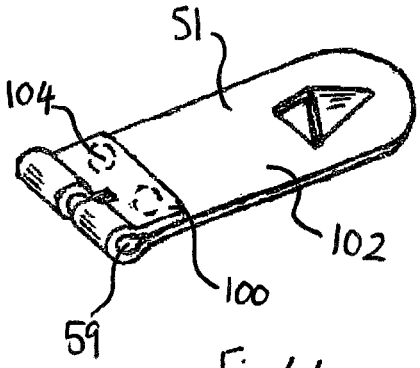
Figure 47:
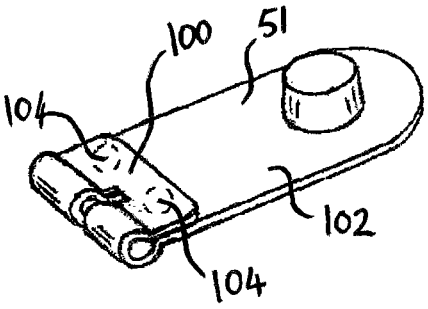

FIGS. 45 to 47 show variations on the locking bar 50, wherein a first end 100 of the main body 51 is rolled over to create the enclosure 59 that can receive the locking pin 59*a*. The first end 100 of the main body 51 and the central portion 102 of the main body 51 are aligned adjacent, preferably parallel, with one another. The first end 100 of the main body 51 is spot welded to the central portion 102 of the main body 51 to retain it in place and provide a stronger and more secure connection. The spot welding 104 can be done in a single spot or in a plurality of positions.

Figure 48:
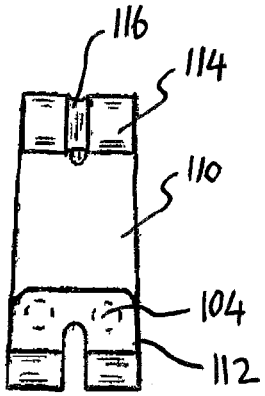
FIG. 48 shows an alternative locking bar.

FIG. 48 shows a second section 110 of a locking bar that has a first rolled end 112 that is rolled over and back onto the main body of the second section of the locking bar where it is spot welded 104 to create part of a pivot connection. This part of a pivot connection is in the form of an enclosure that can receive a locking pin to connect the second part 110 of the locking bar to a first part of the locking bar. At the opposite end of the second section 110 of the locking bar, a further rolled section 114 is provided that has a strengthening section in the form of a depression 116 therein. The depression 116 provides strength to the rolled section 114 to increase its resistance to deformation. The depression 116 could be substituted with a rib, if required.

Figure 49:
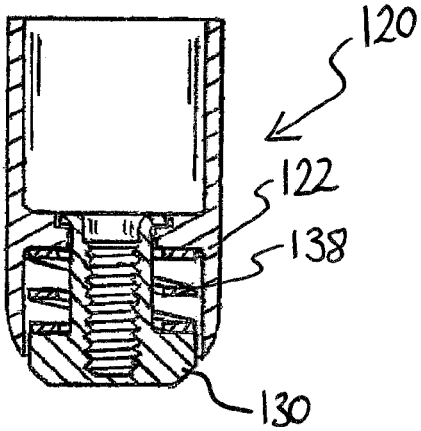
FIGS. 49 to 51 show a further embodiment of the present invention.
Figure 50:
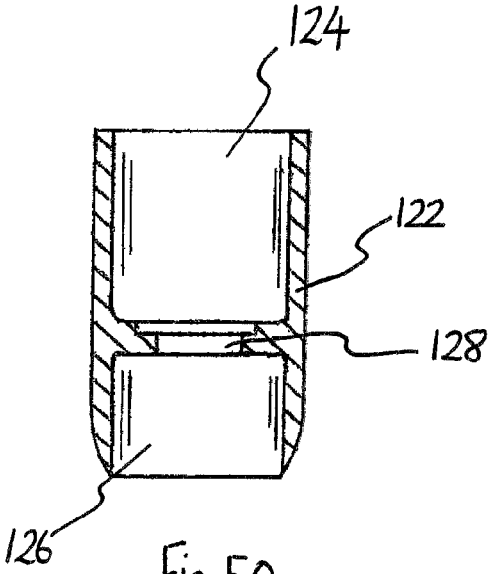
Figure 51:
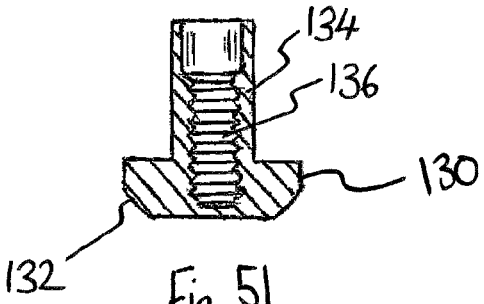

FIGS. 49 to 51 show a further arrangement 120 in which a housing 122 has a first recess 124 and a second recess 126 connected by a channel 128. A rear insert 130 is provided that has a head section 132 and an extension section 134, the extension section 134 having a threaded recess 136 therein. The rear insert 130 is arranged within the second recess 126 of the housing with the threaded recess 136 being aligned with the channel 128, with damping elements 138 positioned between, and abut, the head section 132 and the inner surface of the second recess 126. A locking bar (not shown) can be screwed into the threaded recess 136 and, when in use, should the locking bar move relative to the housing, the damping elements 138 can resist and absorb some of the force on the device. The damping elements 138 may be arcuate metallic discs, such as spring or wave washers, rubber or plastics materials or other force absorbing materials.

Figure 52:
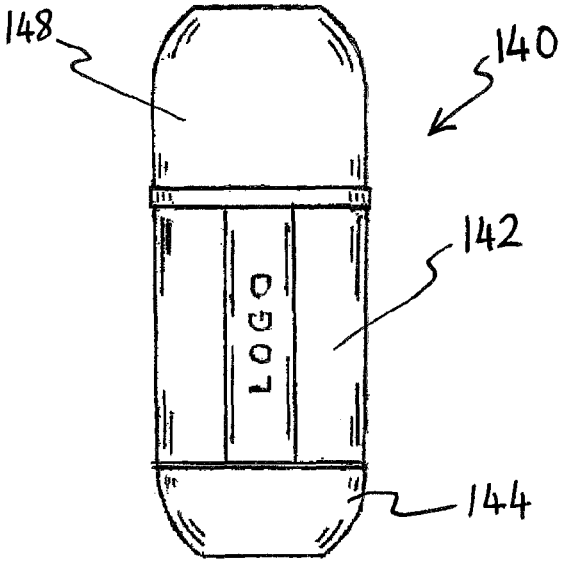
FIGS. 52 to 54 show another embodiment of the present invention.
Figure 54:
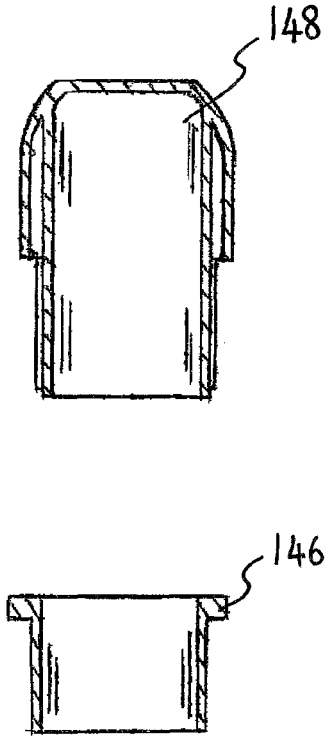
Figure 54:
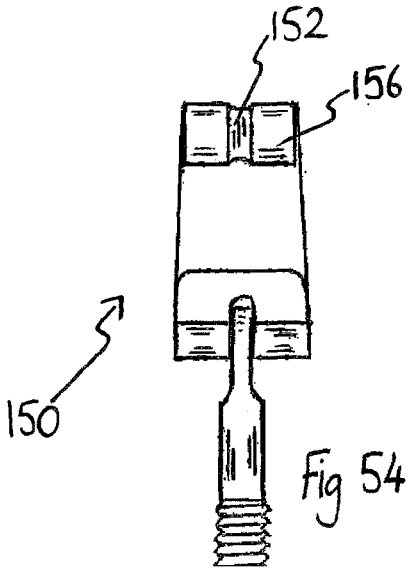
Figure 53:
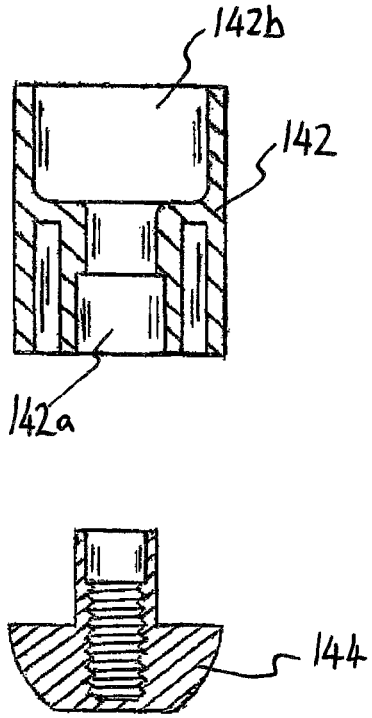

FIGS. 52 to 54 show a device 140 having a housing 142 in the form of a cylindrical element having a first recess 142*a* and a second recess 142*b*, the former of which receives a rear insert 144, similar in arrangement to that shown in FIGS. 49 to 51, and a front plug 146 is arranged to be received within the second recess 142*b*. A lid section 148 is provided that engages with the housing 142, A locking bar 150 is provided that threadedly engages with a recess in the rear insert 144. The locking bar 150 is provided with a second section as shown in FIG. 48 and having a strengthening element 152 in the protrusion 156 thereof, the protrusion 156 being in the form of a roller section. When assembled with the lid 148 engaged on the housing 142, the device is capsule in shape.

The first and second sections of the locking bar may be arranged parallel with one another or perpendicularly.

Elements of the embodiments described herein may be interchanged into other embodiments described herein.

The invention claimed is:

1. A door locking system comprising:

a locking bar having a first section and a second section pivotally connected to the first section by way of a pivotal connection, the second section being provided with a protrusion configured to engage with an aperture of a strike plate secured to a door frame, the pivotal connection being orientated with an axis of rotation that is non-parallel with a longitudinal axis of the locking bar; and a housing having a first end comprising a face and a recess provided therein;

wherein the first section of the locking bar is received and retained within the recess of the housing;

wherein the housing includes a second recess connected by a channel to the recess, and wherein the system further comprises a rear insert having a head section and an extension section, the extension section having a threaded recess therein configured to receive and engage with threading of the first section of the locking bar;

wherein the rear insert being arranged within the second recess of the housing with the threaded recess being aligned with the channel, and wherein a damping element being positioned between, and abut, the head section and an inner surface of the second recess, and wherein the damping element being configured to resist and absorb movement of the locking bar relative to the housing.

2. The door locking system according to claim 1, wherein the pivotal connection is transverse with the longitudinal axis of the locking bar.

3. The door locking system according to claim 2, wherein the face of the housing is provided with a protective material.

4. The door locking system according to claim 3, wherein the protective material being selected from the group consisting of one or any combination of plastics, rubbers and elastomeric materials.

5. The door locking device according to claim 2, wherein the housing comprises a plug of protective material that is received within the housing, wherein a portion of the plug is configured to cover the face of the housing.

6. The door locking system according to claim 1, wherein the face of the housing and the recess therein are set back from the first end of the housing such that, when the locking bar is received within the recess of the housing, the pivot connection of the locking bar is positioned within the first end of the housing.

7. The door locking system according to claim 1, wherein the housing comprises a first part of a connection mechanism and a lid section is provided with a second part of the connection mechanism, and wherein the first part and the second part are engaged, at least part of the locking bar that extends from the housing is received within the lid section.

8. The door locking system according to claim 7, wherein, when the housing and the lid section are engaged with one another, the device is capsule in shape.

9. The door locking device according to claim 1, wherein at least one end of the locking bar is rolled back onto itself.

10. The door locking system according to claim 9, wherein both ends of the locking bar are rolled back onto itself and at least one of those ends is secured thereon.

11. The door locking system according to claim 1 further comprising a washer defining a central aperture or through slot sized to receive the locking bar, the washer including a front surface configured to abut a surface of a door, and a lower surface configured to abut moulding or architrave associated with the door.

12. The door locking system according to claim 1, wherein the damping element is one or combination of arcuate metallic discs, a spring, wave washers, and rubber or plastics materials.

13. The door locking system according to claim 1, wherein at least a portion of the first section of the locking bar is threadably engageable with the rear insert.

14. The door locking system according to claim 13, wherein the first section of the locking bar is a threaded rod or a flat bar including threading on opposite edges thereof.

15. A method of using a door locking system for locking a door, the method comprising the steps of:

a) providing a door locking device including a locking bar having a first section and a second section pivotally connected to the first section by way of a pivotal connection, and a housing having a first end comprising a face and a recess provided therein, the pivotal connection being orientated with an axis of rotation that is non-parallel with a longitudinal axis of the locking bar;

b) placing a protrusion of the second section of the locking bar into a recess on a doorframe associated with the door;

c) closing the door such that the locking device is positioned between the door and the door frame;

d) inserting the first section of the locking bar in the recess of the housing so that the first section is retained within the recess of the housing; and e) adjusting an axial position of the housing relative to the protrusion to position the housing at a distance to the door to prevent the door from being opened;

wherein the housing includes a second recess connected by a channel to the recess, and wherein the system further comprises a rear insert having a head section and an extension section, the extension section having a threaded recess therein configured to receive and engage with threading of the first section of the locking bar;

wherein the rear insert being arranged within the second recess of the housing with the threaded recess being aligned with the channel, and wherein a damping element being positioned between, and abut, the head section and an inner surface of the second recess, and wherein the damping element being configured to resist and absorb movement of the locking bar relative to the housing.

* * * * *